United States Patent [19]

Ieki

[11] Patent Number: 4,634,925

[45] Date of Patent: Jan. 6, 1987

[54] ELECTRON GUN FOR A HIGH POWER KLYSTRON

[75] Inventor: Hiroshi Ieki, Amagasaki, Japan

[73] Assignee: Mitsubishi Denki Kabushiki Kaisha, Tokyo, Japan

[21] Appl. No.: 651,854

[22] Filed: Sep. 18, 1984

[30] Foreign Application Priority Data

Oct. 7, 1983 [JP] Japan ..... 58-188994

[51] Int. Cl.[4] ..... H01J 29/46

[52] U.S. Cl. ..... 313/454; 313/448

[58] Field of Search ..... 313/448, 449, 452, 454

[56] References Cited

U.S. PATENT DOCUMENTS

| | | | |
|---|---|---|---|
| 2,644,906 | 7/1953 | Bondley | 313/448 |
| 3,023,336 | 2/1962 | Frenkel | 313/452 |
| 3,295,066 | 12/1966 | Anderson | 313/454 |
| 3,500,110 | 3/1970 | Windsor | 313/454 |
| 3,614,520 | 10/1971 | Coleman | 313/449 |
| 3,843,902 | 10/1974 | Miram et al. | 313/454 |
| 3,963,955 | 6/1976 | Miram et al. | 313/452 |
| 3,983,446 | 9/1976 | Miram et al. | 313/452 |
| 4,399,388 | 8/1983 | Hamano et al. | 313/449 |

FOREIGN PATENT DOCUMENTS

| | | | |
|---|---|---|---|
| 2028576 | 3/1980 | United Kingdom | 313/449 |

*Primary Examiner*—David K. Moore

*Attorney, Agent, or Firm*—Birch, Stewart, Kolasch and Birch

[57] ABSTRACT

An electron gun for a high power klystron which includes a cathode which emits electrons; a focus electrode which, connected to the cathode through a supporting member composed of a material of high electric resistivity, makes the electrons emitted from the cathode produce an electron beam; and an anode which accelerates the electron beam produced by the focus electrode. The supporting member composed of a material of high electric resistivity may alternately be provided between the first and the second portions of the focus electrode, or between the cathode and the second focus electrode portion, wherein the two focus electrode portions are arranged adjacently to each other in the axial direction of the device, and wherein the first focus electrode portion is directly connected to the cathode.

6 Claims, 3 Drawing Figures

ELECTRON GUN FOR A HIGH POWER KLYSTRON

FIELD OF THE INVENTION

The present invention relates to an electron gun for a high power klystron, and more particularly to that wherein the construction of the focus electrode is improved to prevent discharge between the anode and the cathode.

BACKGROUND OF THE INVENTION

In order to explain the background of the invention, reference will be particularly made to FIG. 1. The reference numerals 1,2, and 3 designate a thermionic cathode, a cylindrical focus electrode and an accelerating anode, respectively, and all of them are arranged so as to produce electron beams 6. The focus electrode 2 is commonly known as a "Wehnelt electrode". The reference numeral 4 designates a heater for heating the cathode 1. The reference numeral 5 designates a vacuum container.

The device of FIG. 1 is operated as follows:

The cathode 1 is heated by the heater 4, and high-voltage pulses are impressed between the anode 3 and the cathode 1, and further between the anode 3 and the focus electrode 2, thereby giving rise to an emission of electron beams 6 from the cathode 1. The electron beams 6 are produced to form a predetermined shape by the function of the focus electrode 2.

However, in operation, a high electric field may occur at the respective portions of the anode 3 and the focus electrode 2 which portions have the least distance therebetween, and in some cases it causes a discharge between confronting surfaces of the two portions. Furthermore, the surface of the focus electrode 2 becomes rough which is caused by a large current in the discharge, and then the electric field thereat increases, resulting in an increased possibility of the discharge.

On the other hand, in the midst of the operation, the cathode material always thermally-vapourizes from the cathode 1, and the vapourized material attaches to the surface of the focus electrode 2. The portion of the focus electrode 2 which is located close to the cathode 1 is in an elevated temperature due to the radiant heat from the cathode 1, and hot electrons are repeatedly emitted from the focus electrode 2 accompanied with a decrease of work function caused by the attachment of cathode material to the focus electrode 2.

Under such construction, there are disadvantages in that a discharge is likely to occur between the cathode and the anode, unfavourably affecting its essential operation, and additionally that electrons are repeatedly emitted from the focus electrode 2.

OBJECTS AND SUMMARY OF THE INVENTION

The present invention is directed to solve the problems pointed out above, and has for its object, to provide an electron gun for a high power klystron that gun being capable of restricting the discharge current from the focus electrode without unfavourably affecting the production of electron beams.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to one aspect of the present invention, there is provided an electron gun for a high power klystron which comprises: a cathode which emits electrons; a focus electrode which, while connected to the cathode through a supporting member composed of a material of high electric resistivity, makes the electrons emitted from the cathode produce an electron beam; and an anode which accelerates the electron beam produced by the focus electrode.

According to another aspect of the present invention, the supporting member composed of a material of high electric resistivity is provided between the first and the second portions of the focus electrode, or between the cathode and the second focus electrode portion, wherein the two focus electrode portions are arranged adjacently to each other in the axial direction of the device, and wherein the first focus electrode portion is directly connected to the cathode.

DETAILED DESCRIPTION OF THE PREFERRED EMBODIMENTS

Figure 1:
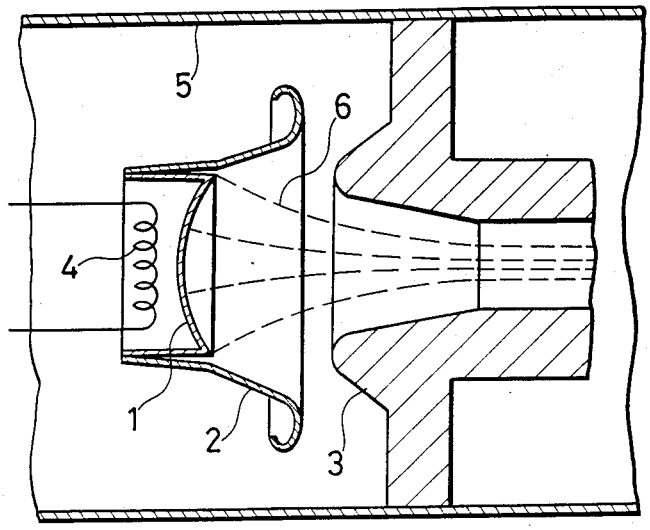
FIG. 1. (PRIOR ART)
FIG. 1 is a diagram showing a cross-section of a conventional electron gun for a high power klystron.

A preferred embodiment of the present invention will be described with reference to FIG. 2, wherein like reference numerals are used to designate like or corresponding parts or elements as those shown in FIG. 1. In this embodiment, the focus electrode 2 is connected to the cathode 1 through a supporting member 7 composed of a material of high electric resistivity (SiC or the like) so as to restrict the discharge current. Accordingly, even if there may arise a discharge between the focus electrode 2 and the anode 3, the discharging current is restricted to a small value by the supporting member 7 of high electric resistivity.

Figure 2:
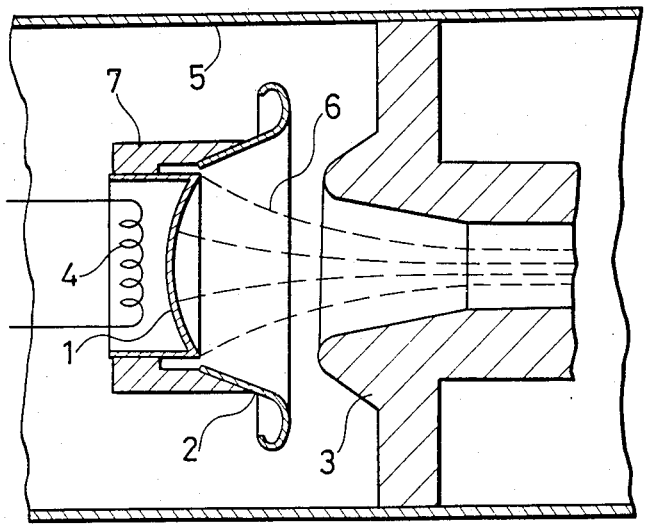
FIG. 2 is a diagram showing a cross-section of a preferred embodiment of the present invention.
Figure 3:
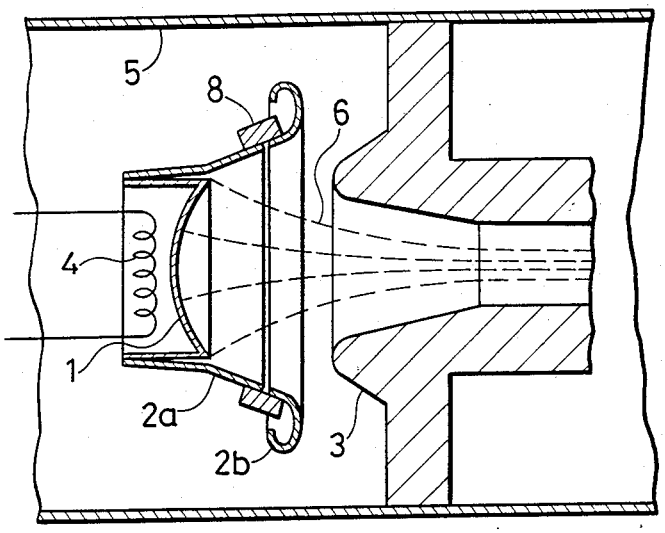
FIG. 3 is a diagram showing a cross-section of another preferred embodiment of the present invention.

Another preferred embodiment of the present invention is shown in FIG. 3 wherein like reference numerals are also used to designate like parts or elements as those shown in FIG. 1 or 2. The reference numerals **2*a* and 2*b* designate a first and a second focus electrode portion which together constitute a cylindrical focus electrode 2. Both electrode portions 2*a* and 2*b* have a cylindrical shape, and are arranged adjacently to each other in the axial direction of the device. The first and the second electrode portion 2*a* and 2*b* are located at the side of the cathode 1 and the anode 3, respectively. These electrode portions 2*a*, 2*b* are both constituted by stainless steel (SUS 304). The second electrode portion 2*b* is connected to the first electrode portion 2*a* through a supporting member 8 which is composed of SiC or the like having high electric resistivity. The first electrode portion 2*a* is connected directly to the cathode 1**.

Under the above-described construction, even in a case where a discharge is likely to occur between the second electrode portion **2*b* and the anode 3, discharge current is restricted to a small value by the supporting member 8 of high electric resistivity provided between the second electrode portion 2*b*, which determines the discharge characteristics, and the cathode 1 through the first electrode portion 2***a*. Also, the discharge is likely to occur at the respective portions of the second electrode portion 2*b* and the anode 3 concentrated at those portions which have the least distance therebetween, and the first focus electrode portion 2*a* located close to the cathode 1 is not unfavourably affected by the discharge.

On the other hand, the vapourized material from the cathode 1 is likely to attach to the first electrode portion 2*a* in the neighborhood of the cathode 1, and electrons are likely to be emitted from the cathode 1 to increase the voltage of the first electrode portion 2*a*, thereby unfavorably influencing upon the production of the electron beam. The electric potential of the first electrode portion 2*a* is kept at the same value as that of the cathode 1 because the former is directly connected to the latter, thereby preventing the fluctuation of the electric potential of the first electrode portion 2*a* caused by the emission of hot electrons. This results in preventing unfavourable affects upon the production of the electron beam.

In the above-illustrated embodiment, the second electrode portion 2*b* is connected to the first electrode portion 2*a* through the supporting member 8, but the second electrode portion 2*b* may be directly connected to the cathode 1 through a supporting member composed of a material of high electric resistivity.

Furthermore, the supporting member 8 may be composed of any material of high electric resistivity which can be used under the condition of vacuum and an elevated temperature.

What is claimed is:

1. An electron gun for a high power klystron, which comprises:

a cathode which emits electrons;

a first cylindrical electrode portion adjacently arranged and connected to said cathode;

a second cylindrical electrode portion arranged adjacent to said first cylindrical electrode portion;

support means, composed of a material of high resistivity, that electrically connects said first cylindrical electrode portion and said second cylindrical electrode portion to reduce discharge currents;

focus electrode means constituted by said first cylindrical electrode portion, said second cylindrical electrode portion and said supporting member which produces an electron beam from the electrons emitted from said cathode; and an anode which accelerates said electron beam produced by said focus electrode means.

2. An electron gun for a high power klystron, which comprises:

a cathode which emits electrons;

focus electrode means producing an electron beam from said electrons emitted from said cathode produce;

an anode which accelerates said electron beam produced by the focus electrode;

said focus electrode means being constituted by a first cylindrical electrode portion and a second cylindrical electrode portion arranged adjacently to each other in the axial direction of the device;

said first cylindrical electrode portion being disposed adjacent to said cathode, and directly connected thereto; and support means, composed of a material of high electric resistivity that connects said second cylindrical electrode portion which is adjacent to said anode, to said cathode to reduce discharge currents.

3. The electron gun for a high power klystron as defined in claim 1, wherein the supporting member is composed of SiC.

4. The electron gun for a high power klystron as defined in claim 2, wherein the supporting member is composed of SiC.

5. The electron gun for a high power klystron of claim 3 wherein said first cylindrical electrode portion and said second cylindrical electrode portion are both composed of stainless steel.

6. The electron gun for a high power klystron of claim 4 wherein said first cylindrical electrode portion and said second cylindrical electrode portion are both composed of stainless steel.

* * * * *